United States Patent [19]

Javillonar

[11] 3,931,950

[45] Jan. 13, 1976

[54] TOOTHPASTE TUBE SUPPORTING DEVICE

[75] Inventor: Michael A. Javillonar, Danbury, Conn.

[73] Assignee: The Raymond Lee Organization, Inc., New York, N.Y. ; a part interest

[22] Filed: Oct. 4, 1974

[21] Appl. No.: 512,023

[52] U.S. Cl. ..... 248/108

[51] Int. Cl.[2] ..... B65D 35/56

[58] Field of Search.... 248/108, 109, 128, 146–150, 248/300, 302, 304, 305, 311, 312, 313; 222/92, 93, 103, 105; 24/84; 53/253; 141/313, 351, 369; 198/131, 210; 269/254 R, 288

[56] References Cited

UNITED STATES PATENTS

| | | | |
|---|---|---|---|
| 1,399,580 | 12/1921 | Rothrock | 248/108 |
| 1,807,083 | 5/1931 | Bracey et al. | 248/108 |
| 2,619,310 | 11/1952 | Winslow | 248/108 |
| 3,387,810 | 6/1968 | Sakier | 248/108 |

*Primary Examiner*—Geo. V. Larkin
*Attorney, Agent, or Firm*—Daniel Jay Tick

[57] ABSTRACT

A support member is affixed to a supporting surface and extends perpendicularly therefrom. The support member has a semicircular groove formed therein. A clamp member is pivotally affixed to the support member and has a semicircular groove formed therein and forms a circular groove with the groove formed in the support member when the clamp member is in closed position with the support member for accommodating the open neck part of a flexible toothpaste tube. A holding device releasably maintains the clamp member and the support member in closed coplanar relation with each other and forms a circular groove coplanar them for accommodating the neck part of the toothpaste tube securely between the members to enable the tube to be emptied.

1 Claim, 3 Drawing Figures

TOOTHPASTE TUBE SUPPORTING DEVICE

DESCRIPTION OF THE INVENTION:

The present invention relates to a toothpaste tube supporting device.

Objects of the invention are to provide a toothpaste tube supporting device of simple structure, which is inexpensive in manufacture, used with facility and convenience, without skill, installed with facility and convenience, and functions efficiently, effectively, and reliably to support a tube of toothpaste for emptying with a single hand of the user.

In order that the invention may be readily carried into effect, it will now be described with reference to the accompanying drawing, wherein.

Figure 1:
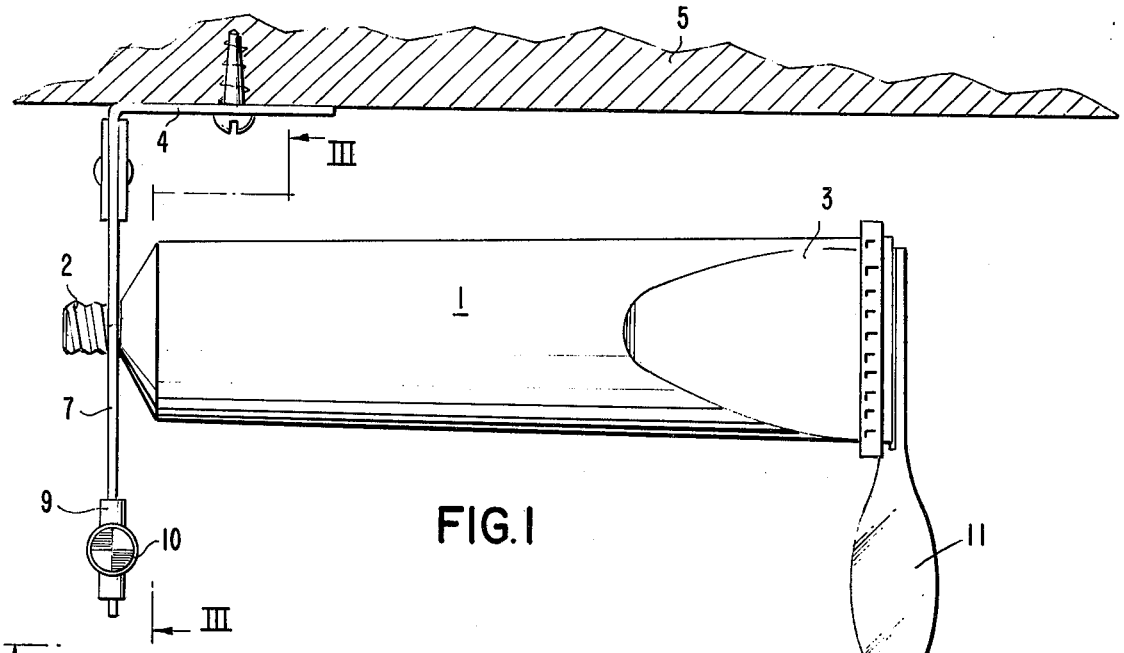
FIG. 1 is a top view of an embodiment of the toothpaste tube supporting device of the invention in use.
Figure 3:
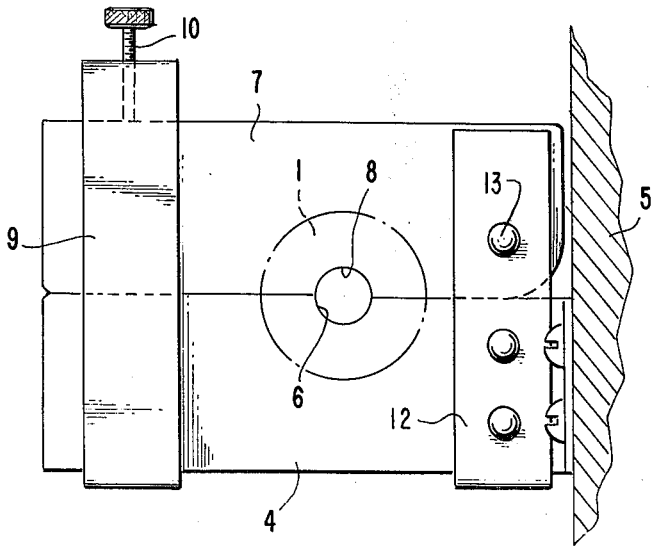

FIG. 3 is a view of the members 4 and 7 and the device 9, taken along the line III — III of FIG. 1.

In the FIGS., the same components are identified by the same reference numerals.

The toothpaste tube supporting device of the invention is for supporting a substantially flexible toothpaste tube 1 having an open neck part 2 through which toothpaste in the tube is ejected and an opposite end part 3. The toothpaste tube supporting device of the invention comprises a support member 4 (FIG. 3) affixed to a supporting surface 5 and extending substantially perpendicularly from said supporting surface. The support member 4 has a substantially semicircular groove 6 (FIG. 3) formed therein. The support member 4 consists of a plate type member bent at right angles so that one part is affixable to the supporting surface 5 and the other part extends at right angles from the supporting surface and has the groove 6 formed therein. The part of the support member 4 affixable to the supporting surface 5 is in juxtaposition with said surface when affixed thereto.

Figure 2:
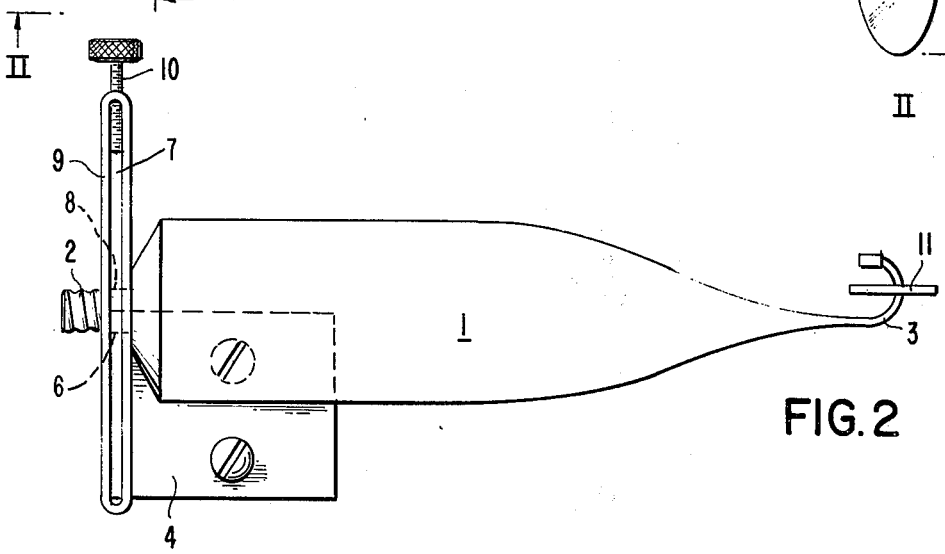
FIG. 2 is a side view, taken along the line II — II, of FIG. 2.

A clamp member 7 is pivotally affixed to the support member 4 and has a substantially semicircular groove 8 (FIG. 3) formed therein and forming a circular groove with the groove 6 formed in the member 4 when the clamp member is in closed position with the support member for accommodating the neck part 2 of the toothpaste tube 1, as shown in FIG. 2. The clamp member 7 is pivotally affixed to the support member 4 via a band 12 affixed to said support member and a pivot pin 13 passing through a bore in the band and the clamp member (FIG. 3) so that said clamp member is movable in the plane of the part of the support member having the groove 6 formed therein.

A holding device 9 releasably maintains the clamp member 7 and the support member 4 in closed substantially coplanar relation with each other and forms a substantially circular groove 6, 8 between them for accommodating the neck part 2 of the toothpaste tube 1 securely between said members to enable the tube to be emptied. The holding device 9 comprises a narrow closed loop member for accommodating the support member 4 and the clamp member 7 therein. A tightening screw 10 is threadedly coupled in the closed loop member. When the support member 4 and the clamp member 7 are in closed position; that is, when said members are in closed, substantially coplanar, position around the neck part 2 of a toothpaste tube 1, the holding device 9 is slipped over the ends of said members and the tightening screw 10 is turned until said holding device holds the support member and the clamp member tightly in closed position. The tightening screw 10 urges the clamp member 7 toward the support member 4 so that the edges of said members having the grooves 6 and 8 formed therein are maintained in juxtaposition.

A slotted key 11 (FIGS. 1 and 2) accommodates the end part 3 of the toothpaste tube 1 secured by the supporting device of the invention, as shown in FIGS. 1 and 2, and functions to empty the contents of the tube via the neck part.

The toothpaste tube supporting device of the invention is for either right-handed people or left-handed people. FIGS. 1 and 2 illustrate the device for right-handed people. These must be turned over 180° to illustrate the device for left-handed people.

The toothpaste tube supporting device of the invention, in a preferred embodiment includes a platform member extending substantially perpendicularly from the support member 4 at the bottom edge thereof. The platform member supports the tube of toothpaste when the device of the invention is not in use, and has a plurality of spaced holes formed therethrough for supporting toothbrushes.

The support member 4 and the clamp member 7 may have additional semicircular grooves formed therein in spaced relation with the grooves 6 and 8. The additional semicircular grooves form a circular groove having a smaller diameter than that of the groove 6, 8. The smaller circular groove is for holding the spout of the toothpaste to empty all the paste.

While the invention has been described by means of a specific example and in a specific embodiment, I do not wish to be limited thereto, for obvious modifications will occur to those skilled in the art without departing from the spirit and scope of the invention.

I claim:

1. A toothpaste tube supporting device for supporting a substantially flexible toothpaste tube having an open neck part through which toothpaste in the tube is ejected and an opposite end part, said toothpaste tube supporting device comprising a substantially plate like support member having a first part affixed to a supporting surface and a second part extending substantially perpendicularly from the first part and the supporting surface, said support member having a substantially semicircular groove formed in an edge thereof;

a clamp member pivotally affixed to the second part of the support member for movement in the plane of said second part and having a substantially semicircular groove formed in an edge thereof and forming a circular groove with the groove formed in the support member when the clamp member is in closed position with the support member with the grooved edges of the members in juxtaposition for accommodating the neck part of a toothpaste tube; and a holding device for releasably maintaining the clamp member and the support member in closed substantially coplanar relation with each other and forming a substantially circular groove between them consisting of the semicircular grooves of the members for accommodating the neck part of a toothpaste tube secure between said members to enable the tube to be emptied.

* * * * *